United States Patent [19]

Rekow

[11] Patent Number: 4,548,323

[45] Date of Patent: Oct. 22, 1985

[54] MAILING CONTAINER AND BLANK THEREFOR

[75] Inventor: Vernon C. Rekow, St. Paul, Minn.

[73] Assignee: Champion International Corporation, Stamford, Conn.

[21] Appl. No.: 313,742

[22] Filed: Oct. 22, 1981

[51] Int. Cl.[4] ..... B65D 5/54; B65D 75/14

[52] U.S. Cl. ..... 206/611; 229/8; 229/75; 229/76; 229/92.7

[58] Field of Search ..... 229/68-84, 229/87 R, 87 B, 87 F, 8, 41 R, 16 R, 92.7; 206/611, 620

[56] References Cited

U.S. PATENT DOCUMENTS

| | | | |
|---|---|---|---|
| 1,060,431 | 4/1913 | Dague | 229/68 |
| 2,940,655 | 6/1960 | Dunning | 229/87 F |
| 3,333,690 | 8/1967 | Marsh | 206/611 |
| 4,125,633 | 11/1978 | Vander Lugt, Jr. | 229/87 F |
| 4,174,041 | 11/1979 | Turner | 206/611 |
| 4,193,501 | 3/1980 | Allen | 206/620 |

FOREIGN PATENT DOCUMENTS

| | | | |
|---|---|---|---|
| 0719147 | 10/1965 | Canada | 229/87 F |
| 0832724 | 4/1960 | United Kingdom | 229/8 |

*Primary Examiner*—George F. Lowrance
*Assistant Examiner*—Jimmy G. Foster
*Attorney, Agent, or Firm*—Evelyn M. Sommer; William W. Jones

[57] ABSTRACT

A mailing container is disclosed which is preferably made of corrugated paperboard. The container is formed from a folded paperboard blank which is pre-cut and scored. The container provides a compact strong receptacle for articles to be transported through the mail so as to supply additional protection for such articles not possible with the use of conventional mailing envelopes.

5 Claims, 3 Drawing Figures

MAILING CONTAINER AND BLANK THEREFOR

This invention relates to an improved receptacle for use in transporting relatively small articles through the mail. More particularly, this invention relates to a receptacle of the character described which is made from corrugated paperboard to provide improved strength as compared with conventional mailing envelopes.

Relatively small articles are presently transported through the mail either in mailing envelopes, which may be padded or unpadded, or in conventional rectangular boxes. The fragility of the articles being transported results in damage to them when an envelope is used due to the envelope's lack of strength. Conventional boxes provide additional protection, but they are sometimes, due to their shape, somewhat unsuited to hold articles of peculiar shape, such as eyeglasses, hearing aids, light bulbs, and the like, without the use of internal cushioning devices.

The container of this invention is preferably made of corrugated paperboard for strength, and has a unique streamlined configuration suitable for handling through the mail. This container is made from a pre-cut, scored corrugated paperboard blank which can be quickly erected into an operable container. The container is suitable for holding fragile articles without specialized internal cushioning and has a unique side wall and end wall construction which effectively resists crushing of the container. The container is relatively diamond shaped in cross section with top and bottom sloping trapezoidal wall panels. The end walls are diamond shaped and are formed from associated pairs of triangular panels. The triangular panels in each pair are inwardly angled and foldably connected to each other at a common base. The diamond shape of the compound triangular end walls provides the container with improved resistance to crushing.

It is, therefore, an object of this invention to provide an improved mailing container having enhanced structural strength for transporting relatively fragile articles through the mail.

It is an additional object of this invention to provide a container of the character described which has a compact configuration with compound trapezoidal top and bottom panels and compound diamond shaped end walls formed from associated pairs of triangular panels.

It is a further object of this invention to provide a container of the character described which is formed from a unitary pre-cut and scored corrugated paperboard blank.

These and other objects and advantages of the invention will be more readily apparent from the following detailed description of a preferred embodiment of the invention taken in conjunction with the accompanying drawings, in which.

Figure 1:
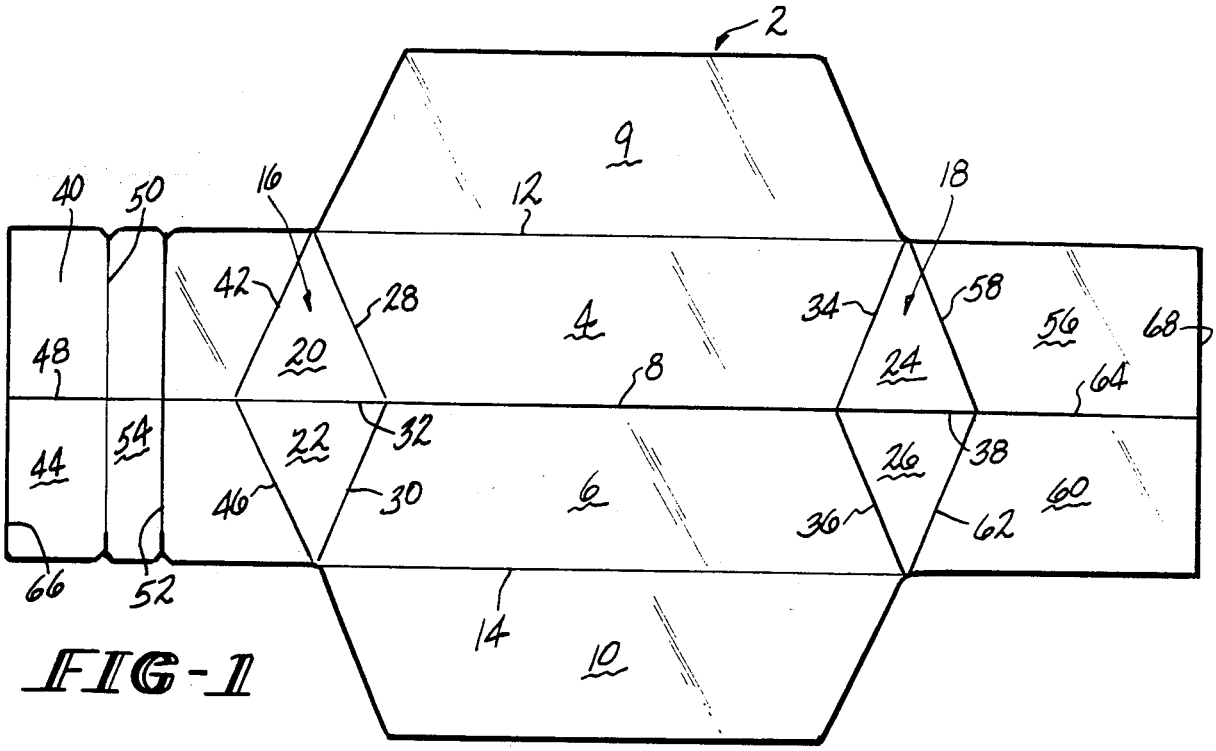
FIG. 1 is a plan view of a preferred embodiment of a pre-cut and scored corrugated paperboard blank from which a container formed in accordance with this invention can be erected.

Referring now to the drawings, there is shown in FIG. 1 a preferred embodiment of a pre-cut and stored corrugated paperboard blank, denoted generally by the numeral 2, from which a preferred embodiment of a container formed in accordance with this invention can be formed. The blank 2 includes a pair of trapezoidal bottom wall panels 4 and 6 which are foldably connected to each other along a score line 8. A pair of trapezoidal top closure flaps 9 and 10 are foldably connected to outer edges of the bottom wall panels 4 and 6 along score lines 12 and 14 respectively. Generally diamond shaped end walls, denoted generally by the numerals 16 and 18, each of which end walls 16 and 18 comprise a pair of triangular panels 20, 22 and 24, 26 respectively, form the ends of the container. The triangular panels 20 and 22 are foldably connected to the bottom wall panels 4 and 6 by score lines 28 and 30, respectively, and the bases of the triangular panels 20 and 22 are foldably connected to each other by a score line 32. Likewise, the triangular panels 24 and 26 are foldably connected to the bottom wall panels 4 and 6 by score lines 34 and 36 respectively, and are foldably connected to each other by score line 38. It will be noted that the score lines 32 and 38 are extensions of the score line 8. It will also be noted that the trapezoidal panels 4, 6, 9 and 10 have their non-parallel edges convergent and of equal length. A trapezoidal top cover panel 40 is foldably connected to the triangular panel 20 by a score line 42, and a complementary trapezoidal top cover panel 44 is foldably connected to the triangular panel 22 by a score line 46. The trapezoidal panels 40 and 44 are foldably connected to each other by a score line 48 which is a continuation of the score lines 32. A pair of parallel cut score lines 50 and 52 extend across the panels 40 and 44 and define a tear strip 54 operable to open the closed container. At the other end of the blank 2, a trapezoidal panel 56 is foldably connected to the triangular panel 24 by a score line 58, and a complimentary trapezoidal panel 60 is foldably connected to the triangular panel 26 by a score line 62. The trapezoidal panels 56 and 60 are foldably connected to each other by a score line 64 which is a continuation of the score line 38. It will be noted that the outer edges 66 and 68 are perpendicular to the score lines 48 and 64. It should be noted that the score lines on the blank 2 are preferably interrupted cut score lines.

Figure 2:
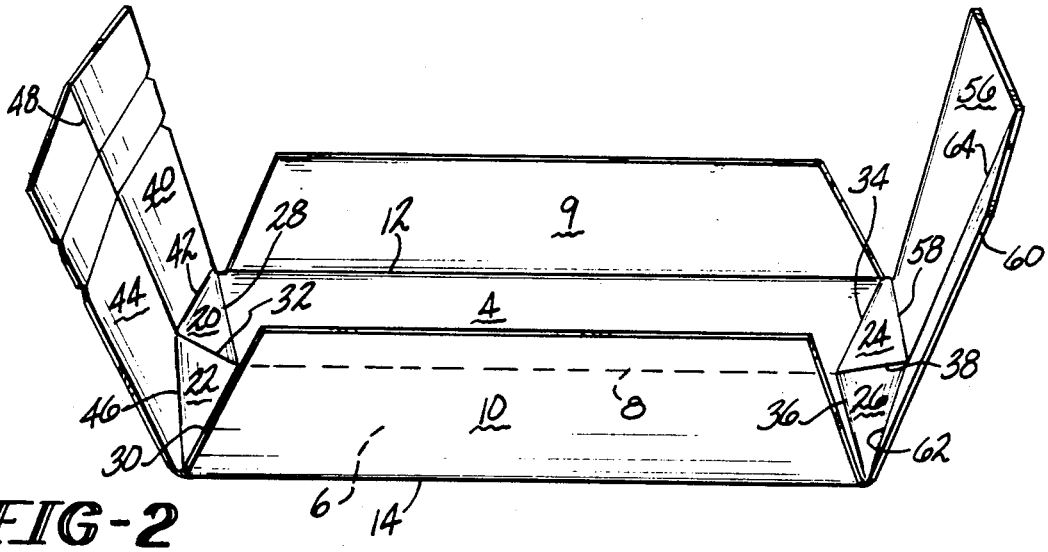
FIG. 2 is a perspective view of the container as it is being erected by properly folding the blank of FIG. 1.

Referring now to FIG. 2, there is shown the initial folding operation performed on the blank 2 preparatory to erecting the blank to its operable form. In the initial folding operation, the top closure flaps 9 and 10 are folded toward each other about the score lines 12 and 14 respectively, and at the same time the bottom wall panels 4 and 6 are folded toward each other about the score line 8. The triangular end wall panels 20, 22 and 24, 26 are folded upwardly about the score lines 28, 30 and 34, 36 respectively, and also folded with respect to each other about the score lines 32 and 38. The top cover panels 40, 44 and 56, 60 are folded down toward each other along score lines 42, 46 and 58, 62 respectively, and the panels 40 and 44, and 56 and 60 are concurrently folded toward each other along score lines 48 and 64 respectively. When the preliminary folding operation is carried to the stage shown in FIG. 2, the article or articles to be packaged are placed in the container.

After the contents are placed in the container, the top closure flaps 9 and 10 are folded down over the packaged contents until the parallel free edges of the flaps are substantially in face to face contact with each other. The top cover panels 40, 44 and 56, 60 are then folded down so as to overlie the top closure flaps 9 and 10 so that the free edges 66 and 68 of the top cover panels are substantially in face to face contact with each other. The top cover panels 40, 44 and 56, 60 are then taped, glued, or otherwise secured in place.

Figure 3:
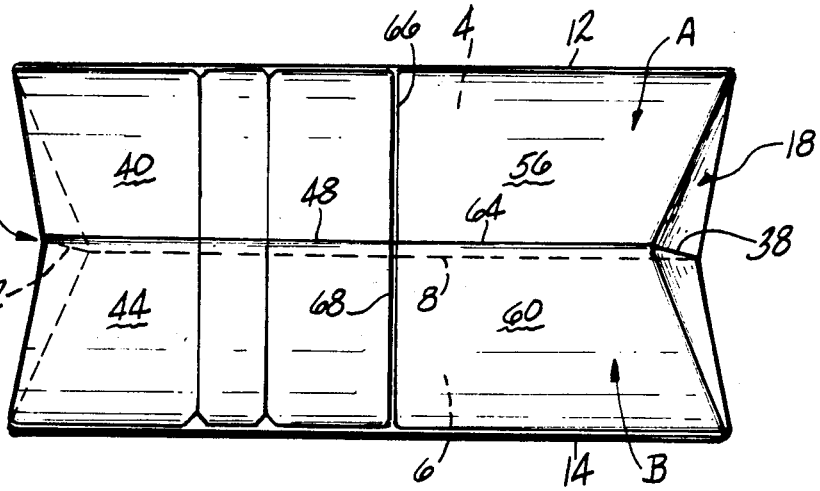
FIG. 3 is a perspective view of the fully erected container as seen looking down on the top closure panel assemblage.

The closed container is shown in FIG. 3. It will be noted that the top cover panels 40 and 56 combine to form a trapezoidal cover panel assemblage A, and the top cover panels 44 and 60 also combine to form a complimentary trapezoidal cover panel assemblage B, with the assemblages A and B being foldably connected by the score lines 48 and 64. The top cover assemblages A and B slope down from the score lines 48 and 64 and terminate above the score lines 12 and 14. The vertical score lines 32 and 38 provide significant structural rigidity to the end walls 16 and 18 thereby strengthening the container in the vertical direction, while the diamond shaped end walls 16 and 18 provide similar structural rigidity in the lateral direction also. It will be understood that the trapezoidal bottom wall panels 4 and 6 slope upwardly and outwardly from the score line 8 and extend to the side score lines 12 and 14 respectively.

It will be readily appreciated that the container of this invention has a streamlined configuration particularly suitable for mail transport, and, at the same time, possesses superior strength. The contents of the container are thus afforded vastly improved protection against damage as compared to conventional mailing envelopes, padded or otherwise. The container is thus particularly suited for containment of relatively fragile articles, without requiring complicated or sophisticated internal cushioning devices.

Since many changes and variations of the disclosed embodiment of the invention may be made without departing from the invention concept, it is not intended to limit the invention otherwise than as required by the appended claims.

What is claimed is:

1. A paperboard container comprising:

(a) a pair of trapezoidal bottom panels foldably connected along a bottom medial score line, said bottom panels having end edges converging inwardly toward said bottom medial score line, said end edges being equal in length, and said bottom panels sloping upwardly away from said bottom medial score line;

(b) a pair of generally diamond shaped end wall assemblies at each end of said container, each end wall assembly comprising a pair of triangular end wall panels with each of said triangular end wall panels being foldably connected to a respective one of said inwardly converging end edges of said bottom panels, with the triangular end wall panels in each pair being foldably connected to each other along a basal score line;

(c) a top cover assemblage comprising a pair of trapezoidal top cover panels having converging end edges of equal length, at least one of said end edges on each of said top cover panels being foldably connected to a corresponding edge of said triangular end wall panels, and said top cover panels sloping downwardly away from a top medial line bisecting said top cover assemblage; and (d) a pair of trapezoidal top cover flaps with each of said top cover flaps being foldably connected to a respective one of said bottom panels, said top cover flaps sloping upwardly toward said top medial line, and said top cover flaps underlying said top cover assemblage.

2. The container of claim 1, wherein said top medial line is a score line foldably connecting said top cover panels together.

3. The container of claim 1 wherein each of said end edges of said top cover panels is foldably connected to a corresponding edge of one of said triangular end walls panels.

4. The container of claim 1, further comprising a tear strip formed in said top cover assemblage to facilitate opening of said container.

5. A paperboard blank for forming a container, said blank comprising:

(a) a medial score line;

(b) a pair of trapezoidal bottom wall panels foldably connected to each other along said medial score line, said bottom wall panels each hving end edges of equal length converging toward each other in the direction of said medial score line;

(c) first and second triangular end wall panels foldably connected to first ones of said end edges of said bottom wall panels, said first and second triangular end wall panels being foldably connected to each other along said medial score line;

(d) third and fourth triangular end wall panels foldably connected to opposite ones of said end edges of said bottom wall panels, said third and fourth triangular end wall panels being foldably connected to each other along said medial score line;

(e) a pair of trapezoidal top cover flaps foldably conncted to outer edges of said bottom wall panels along score lines which are parallel to said medial score line, said connected bottom wall panels, top cover flaps, and triangular end wall panels together forming a hexagon; and (f) a top cover assemblage comprising first and second pairs of trapezoidal top cover panels, one pair of which is foldably connected to said first and second triangular end wall panels and extends from one corner of said hexagon, and the other pair of which is foldably connected to said third and fourth triangular end wall panels and extends from the opposite corner of said hexagon, with the individual trapezoidal top cover panels in each pair being foldably connected to each other along said medial score line.

* * * * *